US010213638B2

(12) United States Patent
Black

(10) Patent No.: US 10,213,638 B2
(45) Date of Patent: Feb. 26, 2019

(54) EXERCISE DEVICE

(71) Applicant: Nichole Mary Black, Scottsdale, AZ (US)

(72) Inventor: Nichole Mary Black, Scottsdale, AZ (US)

( * ) Notice: Subject to any disclaimer, the term of this patent is extended or adjusted under 35 U.S.C. 154(b) by 25 days.

(21) Appl. No.: 15/457,905

(22) Filed: Mar. 13, 2017

(65) Prior Publication Data

US 2017/0266478 A1 Sep. 21, 2017

Related U.S. Application Data

(60) Provisional application No. 62/310,642, filed on Mar. 18, 2016.

(51) Int. Cl.
*A63B 21/072* (2006.01)
*A63B 22/20* (2006.01)

(52) U.S. Cl.
CPC ..... *A63B 21/0724* (2013.01); *A63B 21/0728* (2013.01); *A63B 22/20* (2013.01)

(58) Field of Classification Search
CPC .. A63B 21/0724; A63B 21/0728; A63B 22/20
See application file for complete search history.

(56) References Cited

U.S. PATENT DOCUMENTS 2,528,213 A * 10/1950 Dantolan ..... A63B 21/072 482/131
4,634,121 A 1/1987 Sasaki
5,334,118 A 8/1994 Dantolan
5,474,511 A * 12/1995 Dantolan ..... A63B 15/005 482/109
7,285,080 B1 10/2007 Chiu
7,297,078 B2 * 11/2007 Libonati ..... A63B 15/005 473/457
7,513,856 B2 * 4/2009 Jones ..... A63B 21/0728 482/107
7,993,250 B2 8/2011 Abbott
8,118,693 B2 * 2/2012 Tande ..... A63B 15/005 473/457
8,187,124 B2 * 5/2012 Ciesar ..... A63B 69/0002 473/457
2001/0001094 A1 * 5/2001 Panes ..... A63B 21/06 482/93
2006/0172070 A1 * 8/2006 Cao ..... B41M 7/0027 427/258

(Continued)

*Primary Examiner* — Megan Anderson
(74) *Attorney, Agent, or Firm* — QuickPatents, LLC; Kevin Prince

(57) ABSTRACT

An exercise device for a person exercising on a support surface includes an elongated bar having two opposed ends. A weight has an aperture therethrough and slides along the bar. At least two rigid weight stops are fixed with the bar at selected locations along the bar, the weight free to slide along the bar therebetween. An end caps may be fixed to each end of the cylindrical bar to capture the weight and any weight stops on the cylindrical bar. In use, with the weight slidably captured on the bar, and at least two of the weight stops fixed with the bar on opposing sides of the weight, the person exercises by moving the bar to slide the weight between the at least two weight stops, or by rolling the weight along the support surface while holding on the cylindrical bar in a sit-up style position.

17 Claims, 8 Drawing Sheets

(56) References Cited

U.S. PATENT DOCUMENTS

| | | | | |
|---|---|---|---|---|
| 2011/0034275 | A1 | 2/2011 | Kim | |
| 2015/0321041 | A1 | 11/2015 | Stephan | |
| 2017/0095688 | A1* | 4/2017 | Stilson ..... | A63B 21/0728 |

* cited by examiner

EXERCISE DEVICE

CROSS-REFERENCE TO RELATED APPLICATIONS

This application claims the benefit of U.S. Provisional Patent Application 62/310,642, filed on Mar. 18, 2016, and incorporated herein by reference.

FIELD OF THE INVENTION

This invention relates to exercise devices, and more particularly to a barbell-type device having a movable and rotatable weighted medicine ball.

DISCUSSION OF RELATED ART

There are a wide variety of weighted exercise devices such as barbells with weights, kettle bells, medicine balls, and the like. Most such prior art devices are not suitable for use with a wide variety of different types of exercises, and as such multiple types of exercise devices must be available in order to exercise a wide variety of muscle groups.

Therefore, there is a need for a weighted exercise device that allows for a wider variety of exercises. Such a needed invention would be simple to set-up and use, and would allow for interchangeable weights of differing values. Such a needed device would require a relatively low amount of floor space, yet provide for a wide variety of exercises in different positions. The present invention accomplishes these objectives.

SUMMARY OF THE INVENTION

The present device is an exercise device for a person exercising on a support surface, such as a ground surface. A cylindrical bar has two opposed ends. A weight has a cylindrical aperture therethrough sized to allow traversing of the cylindrical bar therethrough.

In some embodiments the weight is the spherical shape and takes the form of an inflatable ball having the aperture therethrough. The weight may have indicia indicating its weight, and the exercise device may include more than one weight, each having different weight measurements.

At least two rigid weight stops are adapted for fixing with the cylindrical bar. Preferably each weight stop includes a clamping mechanism adapted for fixing the weight stop at a selected position along the cylindrical bar when in a locked position. In an unlocked position, the weight stop is free to slide along the cylindrical bar.

Some embodiments include two end caps each fixable with one of the two opposing ends of the cylindrical bar. Such an end cap may be fixed to the end of the cylindrical bar with a set screw, or the like, so that the weight and any weight stops are captured on the cylindrical bar between the two end caps. In some embodiments the weight further includes a pair of rigid weight blocks fixed at either side of the weight at the aperture therethrough.

In use the cylindrical bar traverses the aperture of the weight and at least two of the weight stops are fixed with the cylindrical bar on opposing sides of the weight. As such, the person exercises by moving the bar to slide the weight between the at least two weight stops by holding both ends of the cylindrical bar and tilting left and right, or by holding one end of the cylindrical bar with both hands and rotating the cylindrical bar between a raised position and a lowered position. Alternately the person can roll the weight along the support surface while holding on the cylindrical bar in a sit-up style position. Other exercises may also be devised with the exercise device for exercising specific muscle groups of the person.

The present invention is a weighted exercise device that allows for a wider variety of exercises, performed in a variety of different positions. The present invention is simple to set-up and use, and allows for interchangeable weights of differing values as desired. The present device requires a relatively low amount of floor space during use, and is relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
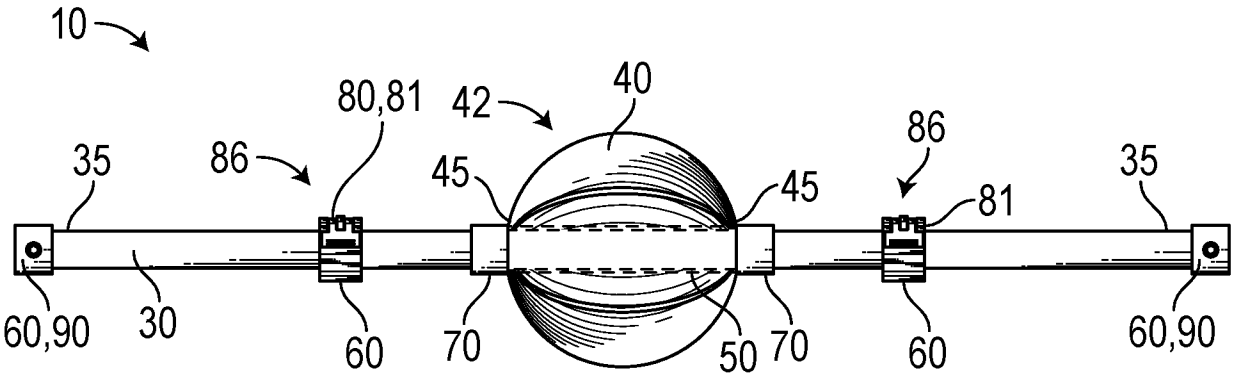
FIG. 1 is a top plan view of the invention.
Figure 2:
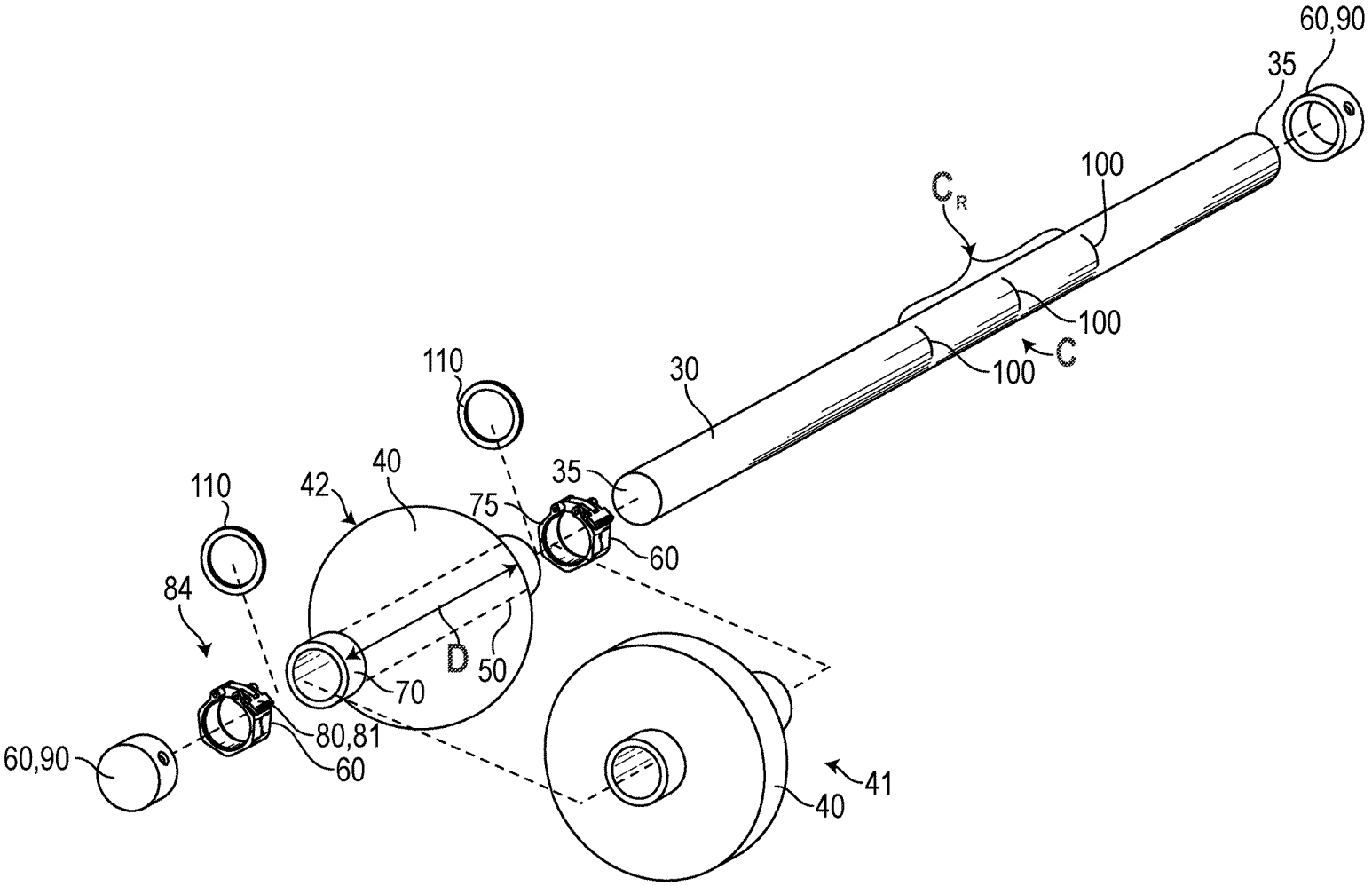
FIG. 2 is an exploded perspective view of the invention, illustrating two embodiments of weights thereof.
Figure 3:
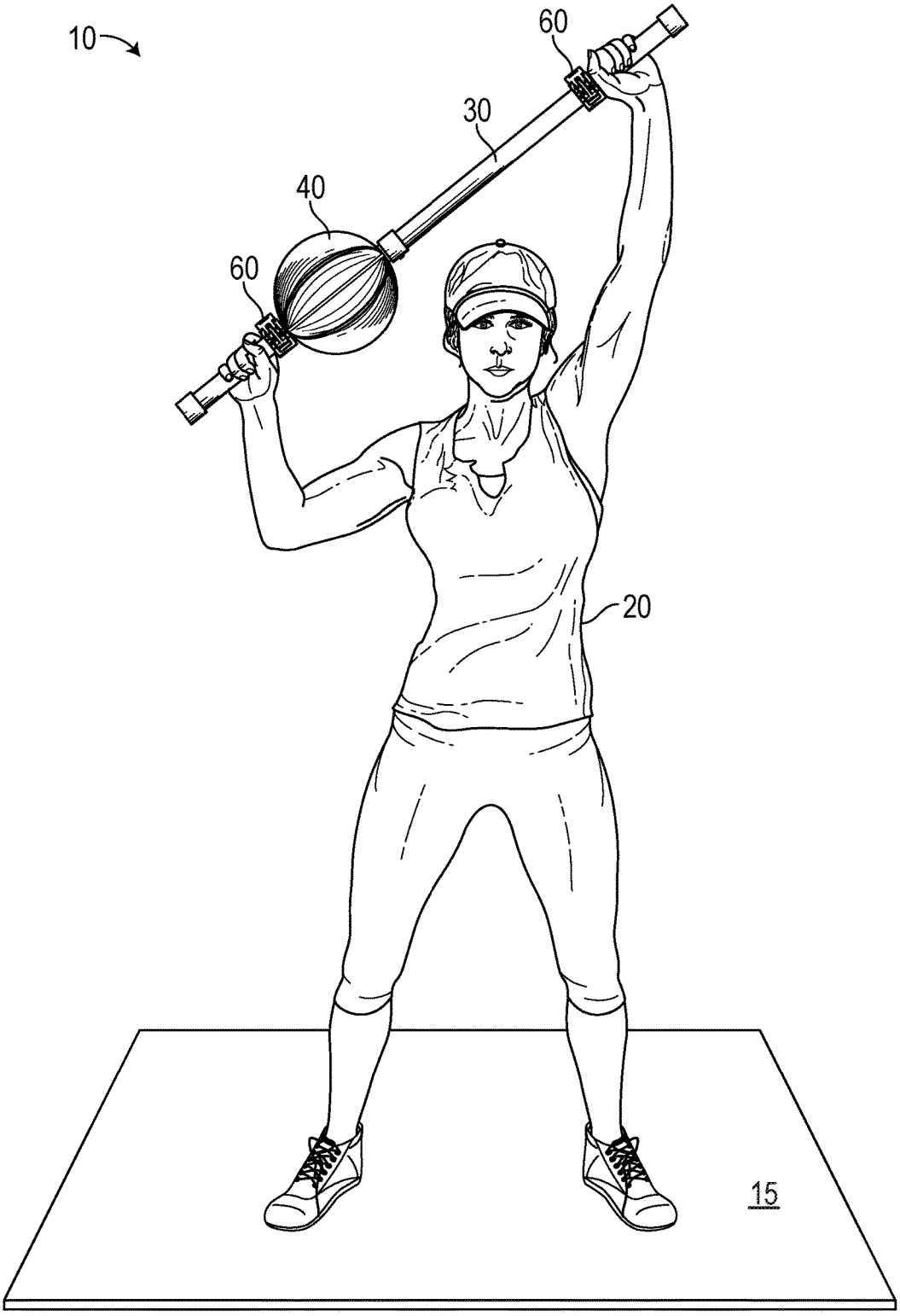
FIG. 3 is a front elevational view of a person performing a first exercise on a support surface with the invention in a first position thereof.
Figure 4:
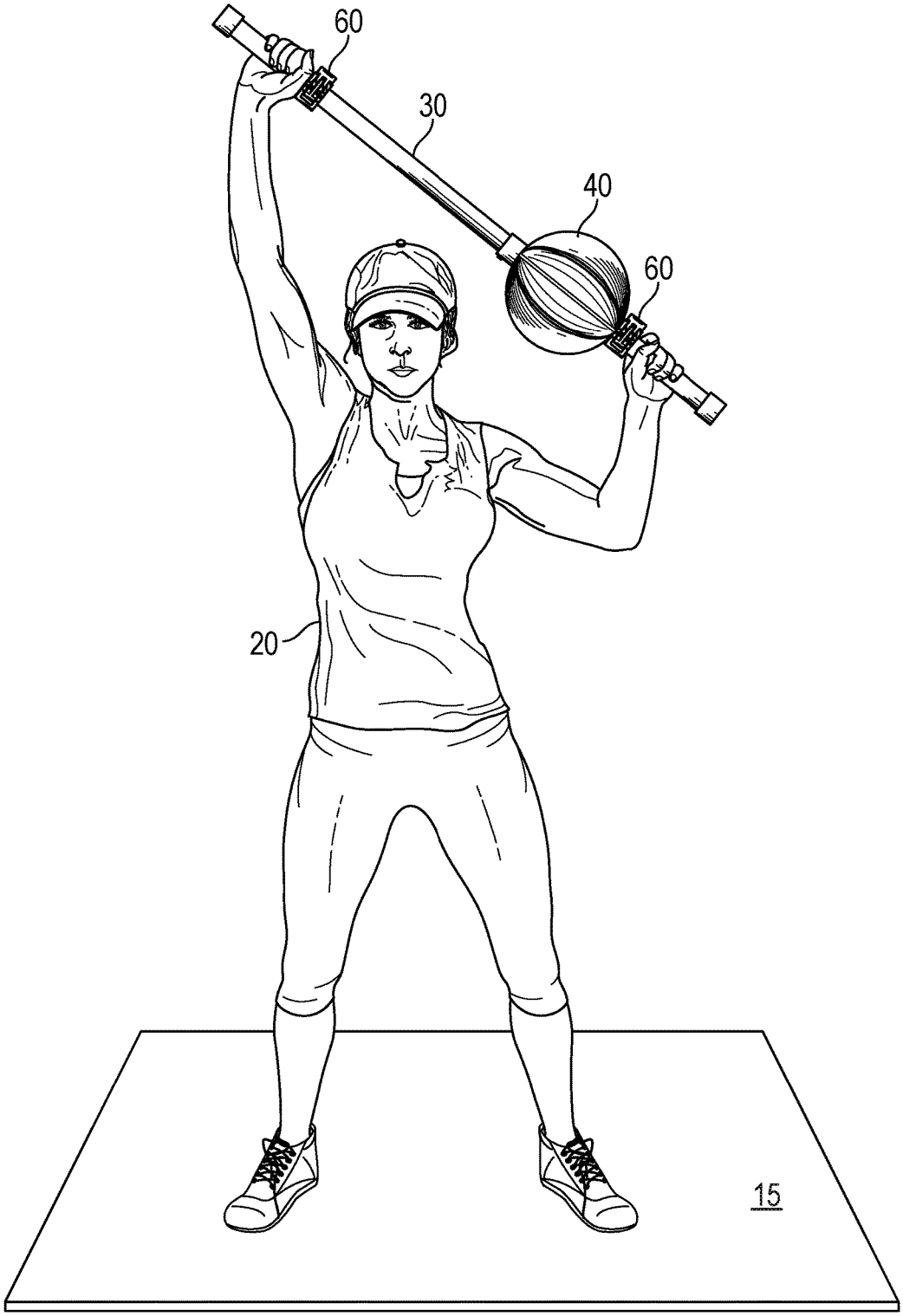
FIG. 4 is a front elevational view of the person performing the first exercise with the invention in a second position thereof.
Figure 5:
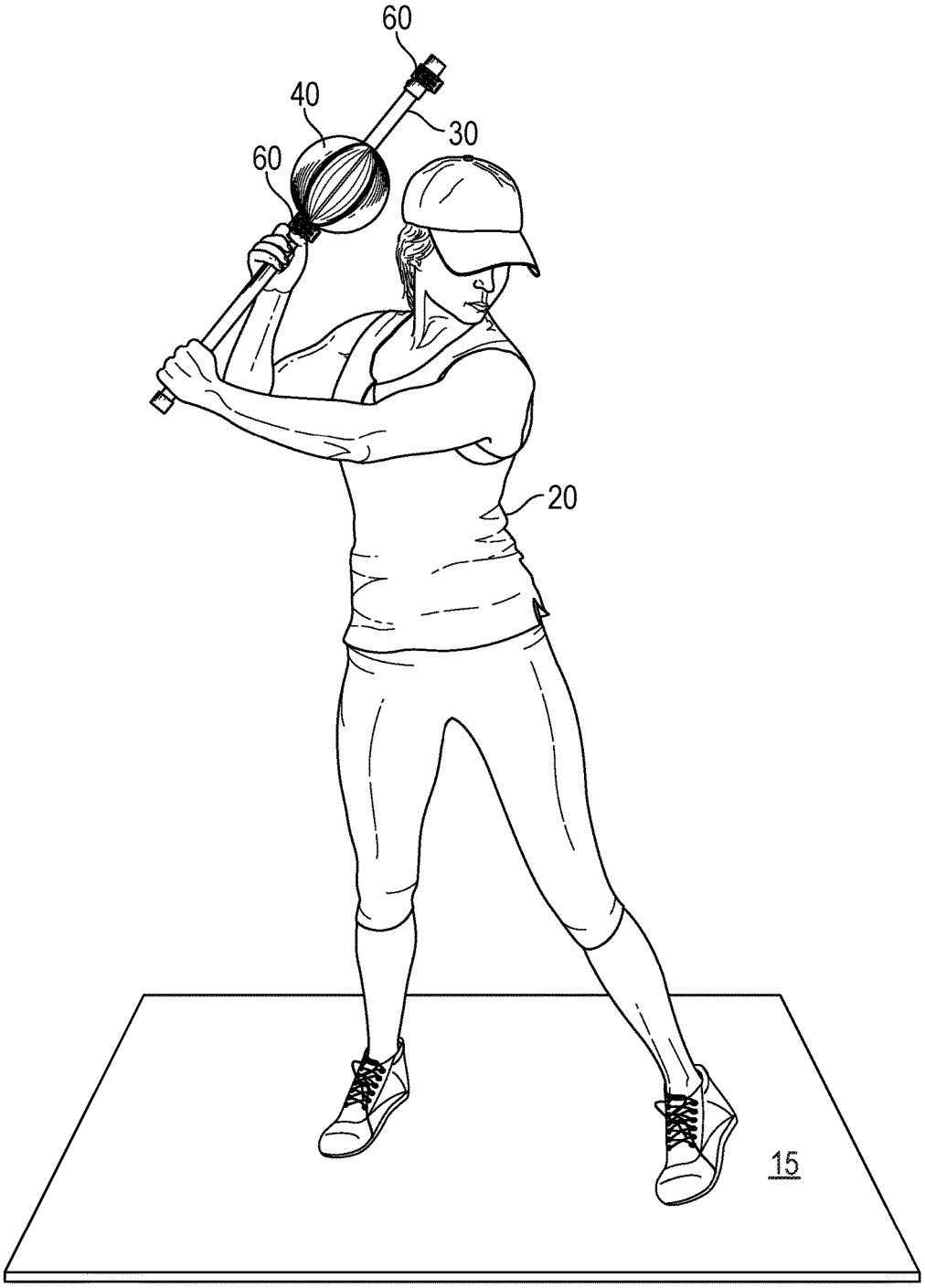
FIG. 5 is a front elevational view of the person performing a second exercise with the invention in a first position thereof.

FIGS. 1-3 illustrate an exercise device 10 for a person 20 exercising on a support surface 15, such as a ground surface. The person 20 may use the exercise device 10 in various positions, such as while standing (FIGS. 3-6), while in a push-up type position (FIG. 7), while in a sit-up type position (not shown), or the like.

A rigid, elongated, cylindrical bar 30 has two opposed ends 35. The cylindrical bar 20 may include indicia 100 to indicate a center position C of the cylindrical bar, or two indicia 100 for indicating a central range $C_R$ of the cylindrical bar. The cylindrical bar 20 is preferably made from a rigid metal material.

A weight 40 has a cylindrical aperture 50 therethrough sized to allow traversing of the cylindrical bar 30 therethrough. The weight 40 may be a cylindrical shape 41, the aperture 50 aligned with a longitudinal axis L thereof. Alternately the weight 40 may be a spherical shape 42, the aperture 50 aligned with a diameter D thereof. The weight 40 may also take some other suitable shape, such as a cylindrical massage roller, a plurality of aligned balls, or the like.

In some embodiments the weight 40 is the spherical shape 42 and takes the form of an inflatable ball having the aperture 50 therethrough. The weight 40 may have indicia 110 indicating its weight, and the exercise device 10 may include more than one weight 40, each having different weight measurements such as 5 pounds, 8 pounds, 10 pounds, etc. In some embodiments the weight 40 is pliable so that if the person 20 contacts the weight 40, such as while doing push-up and rolling exercises on the support surface 15 (FIG. 7), for example, the person 20 is less likely to be injured.

At least two rigid weight stops 60 are adapted for fixing with the cylindrical bar 30. Preferably each weight stop 60 includes a clamping mechanism 80, such as a single-action cam lock mechanism 81, adapted for fixing the weight stop 60 at a selected position along the cylindrical bar 30 when in a locked position 86. In an unlocked position 84, the weight stop 60 is free to slide along the cylindrical bar 30. Each weight stop 60 is preferably made with a strong metal or plastic material.

Some embodiments include four weight stops 60 (FIGS. 1 and 8-12), two of which include the clamping mechanism 80, and two of which take the form of end caps 90 each fixable with one of the two opposing ends 25 of the cylindrical bar 20. Such an end cap 90 may be fixed to the end 25 of the cylindrical bar 20 with a set screw, or the like, wherein a tool is required to remove the end cap 90 from the cylindrical bar 20. As such the weight 40 and any additional weight stops 60 captured on the cylindrical bar 20 between the two end caps 90 do not fall off of the cylindrical bar 20 and are not easily removed for safety. In one embodiment, one of the end caps 90 is permanently fixed to the bar 20 with adhesive (not shown) or other permanent affixing means.

In some embodiments the weight 40 further includes a pair of rigid weight blocks 70 fixed at either side 45 of the weight 40 at the aperture 50 therethrough (FIG. 2). Each weight block 70 is adapted for abutting contact with one of the weight stops 60, preferably at an annular surface 75 thereof. As such, when the weight block 70 makes contact with the weight stop 60, which may also include the annular surface 75, a sharp clap noise is produced, providing feedback to the person 20 that the weight 40 has reached the weight stop 60 and that the direction of the cylindrical bar 20 may be reversed. Each weight block 70 is preferably made with a strong metal or plastic material, but can also be made of an elastomeric material if contact noise between the weight block 70 and the weight stop 60 is desired to be relatively low. Alternately, a sound-absorbing disk 110 may be fixed between the weight 40 (or weight block 70) and each weight stop 60. As such, the sound-absorbing disk 110 attenuates any impact noise between the weight 40 (or weight block 70) and each weight stop 60 and sound-absorbing disk 110. Such a sound-absorbing disk 110 may be made from a soft plastic material such as urethane, or resilient foam material for further providing some protection against fingers of the person being pinched between the weight 40 (or weight block 70) and the weight stop 60.

Figure 6:
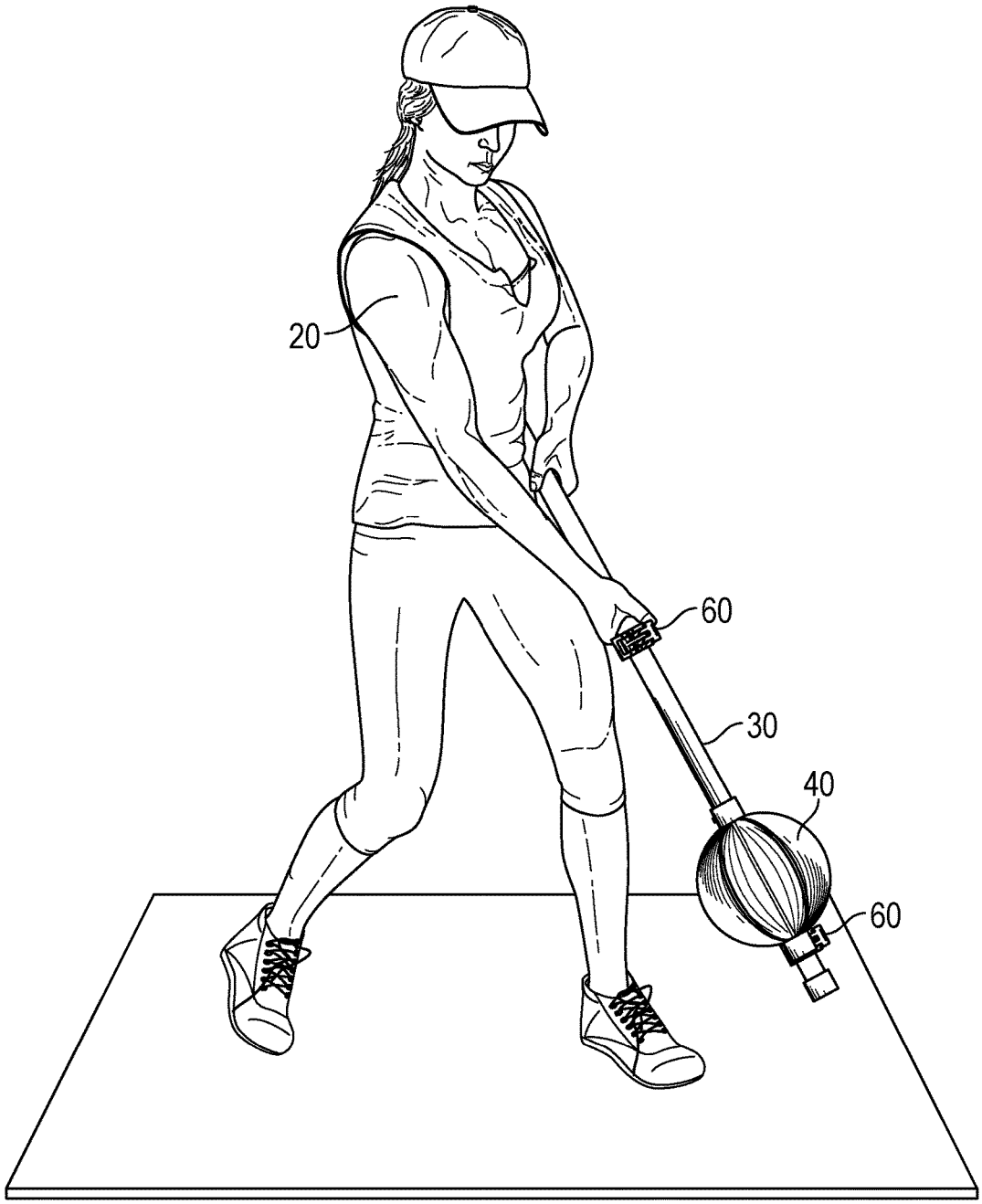
FIG. 6 is a front elevational view of the person performing a second exercise with the invention in a second position thereof.
Figure 7:
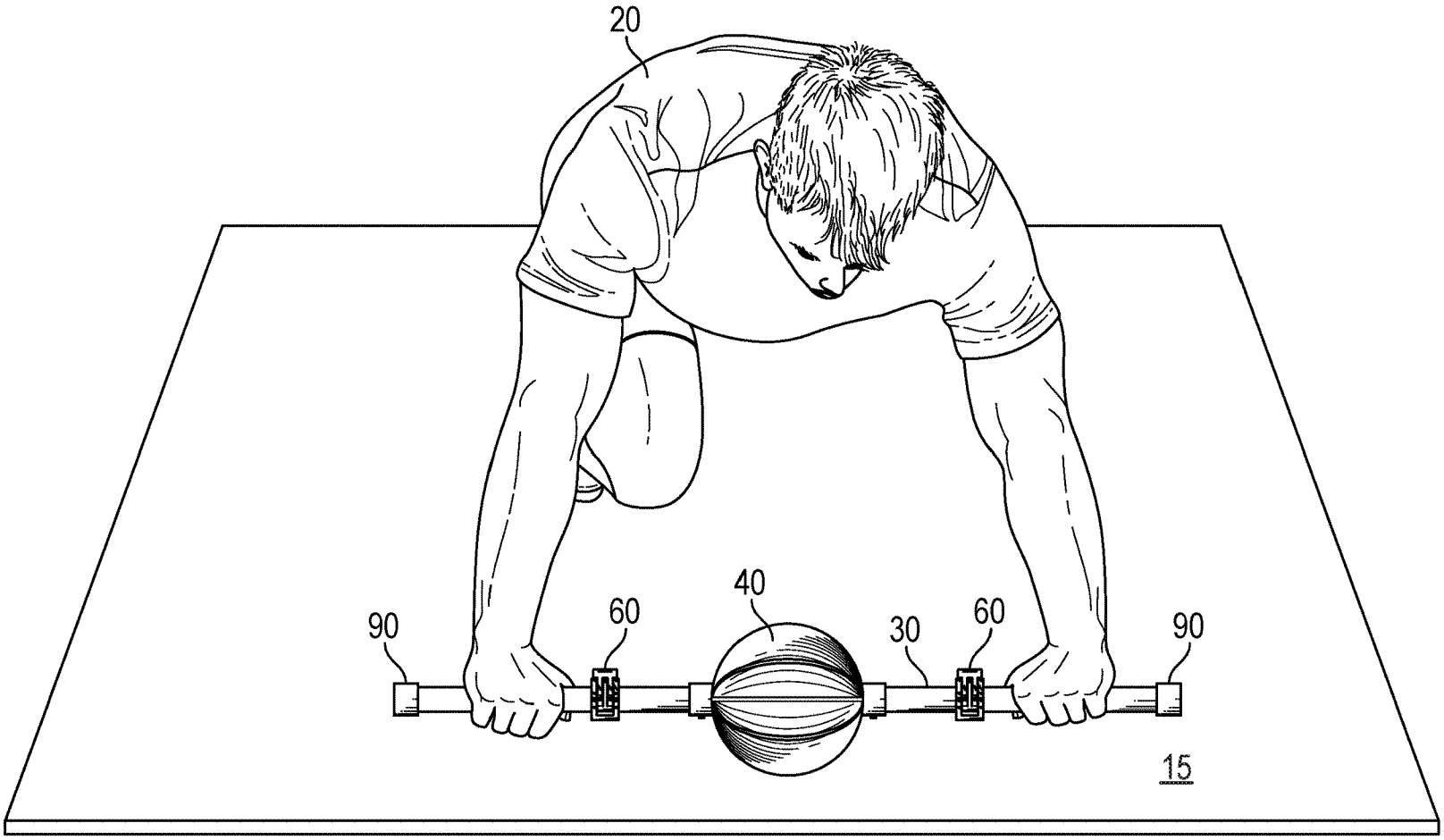
FIG. 7 is a front elevational view of a person performing a third exercise on a support surface with the invention.
Figure 8:
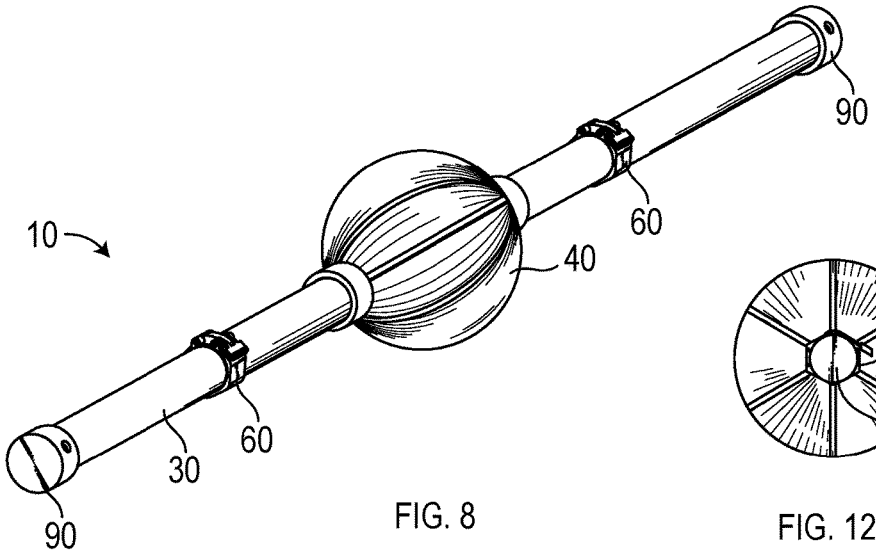
FIG. 8 is a perspective view of FIG. 1.
Figure 12:
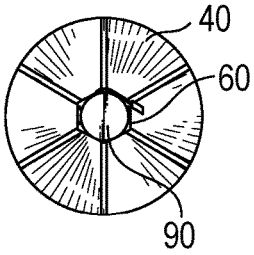
FIG. 12 is a left-side elevational view of FIG. 1, the right-side elevational view being a mirror image thereof.
Figure 9:
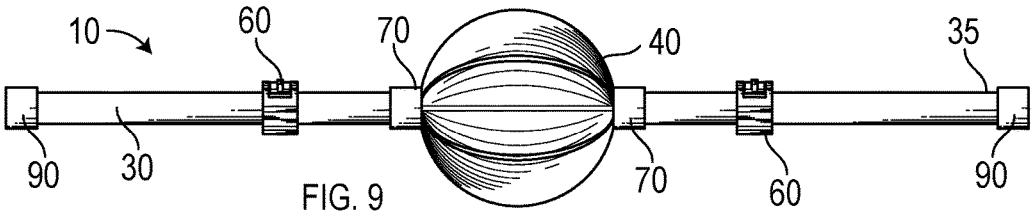
FIG. 9 is a bottom plan view of FIG. 1.
Figure 10:
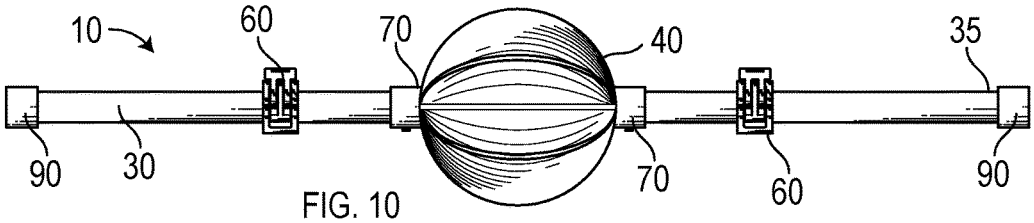
FIG. 10 is a rear elevational view of FIG. 1.
Figure 11:
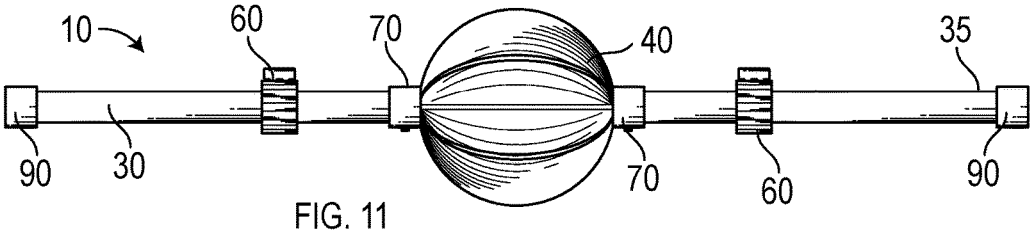
FIG. 11 is a front elevational view of FIG. 1.

In use the cylindrical bar traverses the aperture 50 of the weight 40 and at least two of the weight stops 60 are fixed with the cylindrical bar 30 on opposing sides of the weight 40. As such, the person 20 exercises by moving the bar 30 to slide the weight 40 between the at least two weight stops 60 by holding both ends 25 of the cylindrical bar 20 and tilting left and right (FIGS. 3 and 4), or by holding one end of the cylindrical bar 20 with both hands and rotating the cylindrical bar between a raised position (FIG. 5) and a lowered position (FIG. 6). Alternately the person 20 can roll the weight 40 along the support surface 15 while holding on the cylindrical bar 20 in a sit-up style position (FIG. 7). Other exercises may also be devised with the exercise device 10 for exercising specific muscle groups of the person 20.

While a particular form of the invention has been illustrated and described, it will be apparent that various modifications can be made without departing from the spirit and scope of the invention. For example, the bar 20 may be a non-circular shape in cross-section, matching the shape of the aperture 50 through the weight 40, if it is desired that the weight 40 not rotate about the bar 20, which may be desirable with an offset weight 40 or other arrangements. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference.

Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device for a person exercising on a support surface, comprising:

a rigid elongated cylindrical bar having two opposing ends;

a weight having a cylindrical aperture therethrough sized to allow traversing of the rigid elongated cylindrical bar therethrough; and at least two weight stops adapted for fixing with the rigid elongated cylindrical bar;

whereby with the rigid elongated cylindrical bar traversing the cylindrical aperture of the weight and the at least two weight stops fixed to the rigid elongated cylindrical bar on opposing sides of the weight, the person exercises by moving the rigid elongate cylindrical bar to unimpededly slide the weight between the at least two weight stops where the weight is configured to directly contact each of the at least two weight stops during use of the exercise device, wherein each of the at least two weight stops are adjustable along the length of the rigid elongated cylindrical bar on both sides of the weight.

2. The exercise device of claim 1 wherein the weight is cylindrical and configured to be rolled along the support surface while holding onto the rigid elongated cylindrical bar.

3. The exercise device of claim 2 wherein the cylindrical aperture in the weight is aligned with a longitudinal axis of the weight.

4. The exercise device of claim 2 wherein the weight is pliable.

5. The exercise device of claim 1 wherein the weight is spherical and configured to be rolled along the support surface while holding onto the rigid elongated cylindrical bar.

6. The exercise device of claim 5 wherein the cylindrical aperture in the weight is aligned with a diameter of the weight.

7. The exercise device of claim 5 wherein the weight is pliable.

8. The exercise device of claim 1 wherein the weight further includes two rigid weight blocks fixed at either side of the weight at the cylindrical aperture therethrough, each of the two rigid weight blocks adapted for abutting contact with respective ones of the at least two weight stops.

9. The exercise device of claim 8 wherein each of the at least two weight stops and each of the two rigid weight blocks include an annular surface for making mutual contact therewith and for producing a sharp clap noise upon making mutual contact.

10. The exercise device of claim 1 wherein each of the at least two weight stops includes a clamping mechanism adapted for fixing each of the at least two weight stops at a selected position along the rigid elongated cylindrical bar when in a locked position, and for allowing each of the at least two weight stops to slide freely along the rigid elongated cylindrical bar in an unlocked position.

11. The exercise device of claim 10 wherein the clamping mechanism includes a single-action cam lock mechanism.

12. The exercise device of claim 1 wherein the at least two weight stops include four weight stops, wherein a first set of two of the four weight stops include a clamping mechanism adapted for fixing each of the first set of two of the four weight stops at a selected position along the rigid elongated cylindrical bar when in a locked position, and for allowing each of the first set of two of the four weight stops to slide freely along the bar in an unlocked position, and wherein a second set of two of the four weight stops are end caps, each fixable with one of the two opposing ends of the rigid elongated cylindrical bar, whereby the two end caps capture the first set of two of the four weight stops and the weight therebetween on the rigid elongated cylindrical bar.

13. The exercise device of claim 12 wherein the clamping mechanism includes a single-action cam lock mechanism.

14. The exercise device of claim 1 wherein the rigid elongated cylindrical bar includes at least one indicia thereon for indicating a center position of the rigid elongated cylindrical bar.

15. The exercise device of claim 1 wherein the rigid elongated cylindrical bar includes at least two indicia thereof for indicating a central range in which the weight must be placed for the weight to be centered along the rigid elongated cylindrical bar.

16. The exercise device of claim 1 further including at least one additional weight, the at least one additional weight is marked with an indicia indicting its weight.

17. An exercise device for a person exercising on a support surface, comprising:

a rigid elongated cylindrical bar having two opposing ends;

a weight having a cylindrical aperture therethrough sized to allow traversing of the rigid elongated cylindrical bar therethrough;

at least two weight stops adapted for fixing with the rigid elongated cylindrical bar; and a pair of sound-absorbing disks, each of the pair of sound-absorbing disks fixed between the weight and a respective one of the at least two weight stops, the pair of sound-absorbing disks attenuating impact noise between the weight and each of the at least two weight stops;

whereby with the rigid elongated cylindrical bar traversing the cylindrical aperture of the weight and the at least two weight stops fixed to the rigid elongated cylindrical bar on opposing sides of the weight, the person exercises by moving the rigid elongated cylindrical bar to unimpededly slide the weight between the at least two weight stops where the weight is configured to directly contact each of the pair of sound-absorbing disks which in turn contact the respective one of the at least two weight stops during use of the exercise device, wherein each of the at least two weight stops are adjustable along the length of the rigid elongated cylindrical bar.

* * * * *